US012624540B2

(12) United States Patent
Coppes et al.

(10) Patent No.: US 12,624,540 B2
(45) **Date of Patent: *May 12, 2026**

(54) DRAINAGE ASSEMBLY HAVING AN END CAP AND RAMP

(71) Applicant: Advanced Drainage Systems, Inc., Hilliard, OH (US)

(72) Inventors: Bryan Coppes, Old Saybrook, CT (US); Irena Makarchuk, Fairfield, CT (US); Dan Swistak, Newmarket, NH (US); George Ives, Tolland, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 132 days.

This patent is subject to a terminal disclaimer.

(21) Appl. No.: 18/167,222

(22) Filed: Feb. 10, 2023

(65) Prior Publication Data

US 2023/0257984 A1 Aug. 17, 2023

Related U.S. Application Data

(60) Provisional application No. 63/309,054, filed on Feb. 11, 2022.

(51) Int. Cl.
*E03F 3/04* (2006.01)
*E03F 1/00* (2006.01)

(52) U.S. Cl.
CPC ..... *E03F 3/04* (2013.01); *E03F 1/003* (2013.01)

(58) Field of Classification Search
CPC .. E03F 1/002; E03F 1/003; E03F 3/04; E02B 11/005
See application file for complete search history.

(56) References Cited

U.S. PATENT DOCUMENTS 980,442 A 1/1911 Schlafly
2,334,779 A 11/1943 Luff
(Continued)

FOREIGN PATENT DOCUMENTS

CN 108487410 A 9/2018

OTHER PUBLICATIONS

Advanced Drainage Systems, Inc., *ADS Driveway Culvert Installation*, Feb. 5, 2013, YouTube, retrieved Sep. 21, 2020, from https://www.youtube.com/watch?v=r817BfCtRGU (3 pages).
(Continued)

*Primary Examiner* — Amber R Anderson
*Assistant Examiner* — Stacy N Lawson
(74) *Attorney, Agent, or Firm* — FINNEGAN, HENDERSON, FARABOW, GARRETT & DUNNER L.L.P.

(57) ABSTRACT

Stormwater management systems, apparatus, and methods for containing and filtering runoff may be provided. In one implementation, a stormwater chamber may be provided. The stormwater chamber may be configured for use with an endcap for connecting a pipe to the stormwater chamber, and the stormwater chamber may include a first end with a scalloped edge portion. The end cap may include a sleeve with an interior projecting edge, an outward projecting edge, a bore shaped to receive a pipe, a first cutout portion at the upper half of the outward projecting edge of the sleeve, and a second cutout at the bottom half of the interior projecting edge of the sleeve. The stormwater chamber may also include a flared end ramp with an inlet end, an outlet end, and a protrusion on the outside of the inlet end that abuts the flared end ramp with the end cap.

16 Claims, 15 Drawing Sheets

(56) References Cited

U.S. PATENT DOCUMENTS

| | | | | |
|---|---|---|---|---|
| 3,048,983 | A | 8/1962 | Crummel | |
| 4,245,924 | A | 1/1981 | Fouss | |
| 4,246,936 | A | 1/1981 | Luz | |
| 4,359,167 | A | 11/1982 | Fouss | |
| 4,523,613 | A | 6/1985 | Fouss | |
| 4,759,661 | A | 7/1988 | Nichols | |
| 4,824,287 | A | 4/1989 | Tracy | |
| 5,017,041 | A | 5/1991 | Nichols | |
| 5,065,554 | A | 11/1991 | Neva | |
| 5,087,151 | A | 2/1992 | DiTullio | |
| 5,129,758 | A | 7/1992 | Lindstrom | |
| 5,156,488 | A | 10/1992 | Nichols | |
| 5,336,017 | A | 8/1994 | Nichols | |
| 5,358,006 | A | 10/1994 | Sweers | |
| 5,401,459 | A | 3/1995 | Nichols | |
| 5,419,838 | A | 5/1995 | DiTullio | |
| 5,441,363 | A | 8/1995 | Gray | |
| 5,498,104 | A | 3/1996 | Gray | |
| 5,511,903 | A | 4/1996 | Nichols | |
| 5,556,231 | A * | 9/1996 | Sidaway | E03F 1/003 405/48 |
| 5,588,778 | A | 12/1996 | Nichols | |
| 5,658,092 | A | 8/1997 | Sweers | |
| 5,839,844 | A | 11/1998 | Nichols et al. | |
| 5,890,837 | A | 4/1999 | Wells | |
| 5,890,838 | A | 4/1999 | Moore, Jr. | |
| 6,076,993 | A | 6/2000 | Gray | |
| 6,270,287 | B1 | 8/2001 | Gray | |
| 6,350,374 | B1 | 2/2002 | Stever | |
| 6,361,248 | B1 | 3/2002 | Maestro | |
| 6,533,498 | B1 | 3/2003 | Quin | |
| D477,381 | S | 7/2003 | Benecke | |
| 6,602,023 | B2 | 8/2003 | Crescenzi | |
| 6,612,777 | B2 | 9/2003 | Maestro | |
| 6,698,975 | B1 | 3/2004 | Benecke | |
| 6,991,734 | B1 | 1/2006 | Smith et al. | |
| 7,008,138 | B2 | 3/2006 | Burnes | |
| 7,052,209 | B1 | 5/2006 | Kruger | |
| 7,118,306 | B2 | 10/2006 | Kruger | |
| 7,134,808 | B2 | 11/2006 | Albone | |
| D537,912 | S | 3/2007 | Benecke | |
| 7,189,027 | B2 | 3/2007 | Brochu | |
| 7,217,063 | B2 | 5/2007 | Moore, Jr. | |
| 7,226,241 | B2 | 6/2007 | DiTullio | |
| 7,237,981 | B1 * | 7/2007 | Vitarelli | E03F 1/003 210/170.03 |
| D549,836 | S | 8/2007 | Desbiens | |
| 7,273,330 | B1 | 9/2007 | Brochu | |
| 7,300,226 | B1 | 11/2007 | Maestro | |
| 7,306,399 | B1 | 12/2007 | Smith | |
| D566,852 | S | 4/2008 | Gaster | |
| 7,351,005 | B2 | 4/2008 | Potts | |
| 7,364,384 | B1 | 4/2008 | Swistak | |
| 7,384,212 | B2 | 6/2008 | Currivan | |
| 7,419,332 | B1 | 9/2008 | Brochu | |
| 7,473,053 | B1 | 1/2009 | Brochu | |
| 7,500,805 | B1 | 3/2009 | Brochu | |
| 7,517,172 | B2 | 4/2009 | Sipaila | |
| 7,611,306 | B1 | 11/2009 | Hallahan | |
| 7,614,825 | B2 | 11/2009 | Kroger | |
| 7,628,566 | B2 | 12/2009 | Miskovich | |
| 7,798,747 | B1 | 9/2010 | de Bruijn | |
| 7,806,627 | B2 | 10/2010 | DiTullio | |
| 7,887,256 | B2 | 2/2011 | Miskovich | |
| 7,914,231 | B2 | 3/2011 | Coppes | |
| D638,094 | S | 5/2011 | DiTullio | |
| D638,095 | S | 5/2011 | DiTullio | |
| 8,007,201 | B2 | 8/2011 | Currivan | |
| D653,352 | S | 1/2012 | Jacques | |
| 8,147,688 | B2 | 4/2012 | Adams | |
| 8,366,346 | B2 | 2/2013 | DiTullio | |
| 8,414,222 | B2 | 4/2013 | DiTullio | |
| 8,425,148 | B2 | 4/2013 | DiTullio | |
| 8,491,224 | B2 | 7/2013 | Cobb | |
| 8,636,444 | B2 | 1/2014 | Currivan | |
| 8,672,583 | B1 | 3/2014 | Mailhot | |
| 8,858,119 | B2 | 10/2014 | Wynne | |
| 8,955,258 | B2 | 2/2015 | Jacques | |
| D728,825 | S | 5/2015 | Miskovich | |
| 9,290,924 | B2 | 3/2016 | Wynne | |
| 9,556,576 | B2 | 1/2017 | Mailhot | |
| 9,580,898 | B2 | 2/2017 | Wynne | |
| 9,637,907 | B2 | 5/2017 | Mailhot | |
| 9,765,509 | B1 | 9/2017 | DiTullio | |
| 9,809,968 | B1 | 11/2017 | Holbrook | |
| D806,827 | S | 1/2018 | Mailhot | |
| D840,499 | S | 2/2019 | DiTullio | |
| 11,028,570 | B2 | 6/2021 | Spires et al. | |
| 2002/0025226 | A1 | 2/2002 | Maestro | |
| 2002/0044833 | A1 | 4/2002 | Kruger | |
| 2002/0067952 | A1 | 6/2002 | Crescenzi et al. | |
| 2003/0095838 | A1 | 5/2003 | Maestro | |
| 2004/0184884 | A1 | 9/2004 | DiTullio | |
| 2005/0074285 | A1 | 4/2005 | Burnes | |
| 2005/0074287 | A1 | 4/2005 | Brochu | |
| 2005/0074288 | A1 | 4/2005 | Moore, Jr. | |
| 2005/0111915 | A1 | 5/2005 | Moore, Jr. | |
| 2005/0238434 | A1 | 10/2005 | Coppes | |
| 2007/0258770 | A1 | 11/2007 | Miskovich | |
| 2008/0138156 | A1 | 6/2008 | Janesky | |
| 2008/0226394 | A1 | 9/2008 | Coppes | |
| 2008/0240859 | A1 | 10/2008 | Sipaila | |
| 2009/0003933 | A1 | 1/2009 | Anderson et al. | |
| 2009/0220302 | A1 | 9/2009 | Cobb et al. | |
| 2010/0059430 | A1 | 3/2010 | Adams et al. | |
| 2010/0329787 | A1 | 12/2010 | Moore, Jr. et al. | |
| 2011/0200391 | A1 | 8/2011 | Mailhot et al. | |
| 2012/0085431 | A1 | 4/2012 | Spano, Jr. et al. | |
| 2013/0008841 | A1 * | 1/2013 | Miskovich | E03F 1/003 210/170.03 |
| 2013/0118625 | A1 * | 5/2013 | Bell | E04D 13/08 138/37 |
| 2015/0211198 | A1 | 7/2015 | Mailhot | |
| 2018/0010325 | A1 | 1/2018 | Mailhot et al. | |
| 2019/0078309 | A1 * | 3/2019 | Recchia | E03F 1/002 |
| 2019/0331267 | A1 * | 10/2019 | Warren | F16L 41/021 |
| 2020/0354941 | A1 * | 11/2020 | Spires | E03F 1/003 |

OTHER PUBLICATIONS

Advanced Drainage Systems, Inc., *StormTech Installation*, Mar. 6, 2015, YouTube, retrieved Sep. 21, 2020, from https://www.youtube.com/watch?v=-PZ9P2NyD44 (4 pages).

International Search Report and Written Opinion of the International Searching Authority from the U.S. Patent and Trademark Office for related International Application No. PCT/US2019/059283, mailed Aug. 12, 2020 (9 pages).

International Search Report and Written Opinion of the International Searching Authority from the U.S. Patent and Trademark Office for related International Application No. PCT/US2020/043543, mailed Oct. 8, 2020 (10 pages).

International Search Report and Written Opinion of the International Searching Authority from the U.S. Patent and Trademark Office for related International Application No. PCT/US2020/043557, mailed Sep. 16, 2020 (7 pages).

* cited by examiner

DRAINAGE ASSEMBLY HAVING AN END CAP AND RAMP

CROSS REFERENCE TO RELATED APPLICATION

This application is based on and claims benefit of priority of U.S. Provisional Patent Application No. 63/309,054, filed on Feb. 11, 2022. The content of the foregoing application is incorporated herein by reference in its entirety.

TECHNICAL FIELD

This disclosure relates generally to systems, apparatus, and methods for fluid run-off management systems. In particular, this disclosure relates to enhanced components of stormwater management systems and components thereof.

BACKGROUND

Fluid run-off systems include systems designed to process rainwater or other fluid run-off and particularly stormwater. Related stormwater management systems known in the art include chamber systems designed primarily for use under parking lots, roadways, and heavy earth loads.

Stormwater chambers may be thermoplastic, injection molded, and formed of polypropylene, polyethylene, or a combination thereof. Such a chamber has an arched cross-section, and is formed to have a long, narrow configuration with an advantageously compact footprint that optimizes use of space. The arch-shaped chamber defines an open bottom. The chamber may be installed and placed on crushed stone or other porous medium, which constitutes a floor of the chamber underlying the arch. The chamber may be formed to include corrugations, which may be advantageously shaped and configured to accommodate efficient stormwater or fluid run-off management and debris collection. One or more chambers include an inlet configured to connect to a stormwater collection system, which may include one or more drain basins that receive fluid run-off from a parking lot, roof, or street. The one or more chambers are designed to distribute collected stormwater into the ground.

During a storm, stormwater or rainwater run-off enters the chamber from the one or more drain basins, and in some system configurations, may exit the chamber by flowing through a conduit connecting the chamber to another system component, such as a basin or another chamber. By way of example, a chamber-type stormwater management system may include an array of chambers buried in crushed stone. The chambers may be connected in parallel or in series.

Stormwater carries debris and solid contaminants that can pass into and through basins, traps, and filters of conventional stormwater management systems. Stormwater may include suspended solids, including dirt, sand, organic debris such as leaves, paper, and plastic. Stormwater management system chambers may be configured to receive stormwater and allow debris to settle to a bottom of the chamber before the stormwater is released into the ground.

Related stormwater management systems known in the art may include a subsystem by which stormwater first flow into a primary chamber situated among a row of chambers dedicated to capturing a large amount of debris. The primary chamber may be encased in a geotextile mesh or filter fabric forming a fine mesh made of any suitable now known or later developed material. Other chambers in the system, including the other chambers in the row of chambers, may also be encased in a geotextile mesh or filter fabric forming a fine mesh made of any suitable material. The filter fabric encases the chamber, interposing the chamber and the crushed stone floor. Debris and solid contaminants have been found to locally mask and block exit points in the filter fabric, impeding outflow of fluid or water from the chamber into the ground.

Accordingly, maintenance is required to ensure optimal functionality of chambers, whether they are primary chambers, other chambers among a row of chambers, chambers in a system without a primary chamber, or chambers in systems with or without other means of debris and solid contaminant collection. Debris is typically manually removed from an interior of a chamber using a device configured to jet water into and through an interior of the chamber to force debris and fluid out of the chamber for collection by vacuum. In particular, jetvac systems use a high-pressure water nozzle to propel water through a length of a chamber to suspend and remove sediment. The high-pressure spray from the nozzle causes the sediment to exit the chamber into, for example, a connected basin wherein the collected sediment is collected by vacuuming. The jetvac system and similar cleaning devices can snag, tear, or otherwise disrupt the filter fabric material, damaging an efficacy and functionality of the chamber. Accordingly, systems have been designed to protect a floor of the chamber. For example, some systems include a multi-layer mat as an additional component used to protect the filter fabric material during a cleaning and maintenance process.

Related chambers known in the art and used in chamber-type stormwater management systems include end caps that attach to the chambers. The ends of the chambers are capped to prevent entry of gravel, earth, or other particulates that would disrupt the filter and drainage functionality of the chamber. The chamber end cap may be formed to include a conduit or pipe stub extending therethrough and defining a channel connecting an interior of the chamber to an exterior thereof. An example end cap and chamber configuration is disclosed by U.S. Pat. No. 7,237,981 to Vitarelli, titled End Cap Having Integral Pipe Stub For Use With Stormwater Chamber, the entire disclosure of which is hereby incorporated herein by reference.

U.S. Pat. No. 7,237,981 to Vitarelli discloses a detachable end cap for a molded plastic stormwater chamber with an integrally welded pipe stub. The stub cantilevers outwardly from an exterior surface of the end cap for connection to a line that carries fluid to or from the chamber. The end cap may be formed of polyethylene, for example, for use with a polypropylene chamber.

Problems may arise when chamber end caps are formed with conduit or pipe stubs integrated into the end cap. For example, an end cap with an integrated pipe stub may be cumbersome to store, stack, transport, and ship between different locations. Removal and reattachment of the integrated pipe stub for shipping purposes may not be feasible as doing so may lead to increased labor costs or may cause leaks or other problems with the stormwater assembly. Forming an end cap with an integrated conduit or pipe stub poses problems during the injection molding process, because the integrated stub may be located too far from a desired injection point and may require additional injection points to properly form, which increases costs and reduces efficiency in forming a molded device. Pipe stubs that are formed separately from end caps and then welded to the end cap are difficult to manufacture and require extensive labor costs and effort to assemble. Therefore, there is a need for an improved detachable end cap that can be nested and stacked for improved efficiencies in forming, shipping, and transporting end caps. Such solutions should provide for the connection of a separate pipe or pipe stub to the chamber and the end cap without the need for welded connections between the pipe stub and end cap, and should provide for the assembly of separate flared end ramp, end cap, and pipe stub components into a completed assembly.

Additional problems may arise in the connection interface between a removeable end cap, a chamber, and a pipe stub. For example, a sleeve in a detachable end cap for guiding a separate pipe stub into the chamber may be sized to accommodate the dimensions of the pipe stub. These dimensions, sometimes involving round, elliptical, or oval shapes, may not align with the dimensions of an arched stormwater chamber, resulting in an incorrect fit between the stormwater chamber and the detachable endcap. Solutions and methods are needed to minimize distortions in the placement of the chamber when connecting to a detachable endcap and to securely connect the separate pipe stub to the chamber. Such solutions may include modifications to the dimensions of an arch at one end of a stormwater chamber to facilitate connection with a detachable end cap. Other solutions may include ribs or catches on the inside of the chamber to act as pipe stops to prevent a pipe from being inserted too far into the chamber. In other embodiments, pipe stubs may be used to secure a removable pipe stub inside the chamber by interlocking with the ribs of a corrugated pipe.

Systems, apparatuses, and techniques for enhancing ease of chamber maintenance in chamber-type stormwater management systems may include use of a flared end ramp that facilitates removal of debris from the chamber during jetting and prevents debris from collecting on an interior surface side of an end cap of the chamber. An example of a flared end ramp is disclosed by U.S. Pat. No. 11,028,570 to Spires, titled Systems, Apparatus, and Methods for Maintenance of Stormwater Management Systems, the entire disclosure of which is hereby incorporated herein by reference.

Problems may arise when flared end ramps are formed integral with chamber end caps. For example, an integrated flared end ramp and end cap may be cumbersome to store, stack, transport, and ship between different locations. The large, non-uniform shape may pose difficulties and inefficiencies in the injection molding process when parts are formed through injection molding techniques. Connecting flared end ramps with end caps or pipe stubs may involve extensive labor costs, often due to a need to weld dissimilar materials together. Therefore, there is a need for an improved detachable flared end ramp that can be separately formed, nested, and stacked for improved efficiencies in making, shipping, and transporting flared end ramps. Solutions should further allow for a connection between flared end ramps, end caps, and/or pipe stubs or pipes without the expense of welding or other expensive connection techniques. Such solutions should provide for the connection of a separate pipe, flared end ramp, and end cap components into a completed assembly. Solutions should further include components and techniques to prevent a separable pipe from sliding down the flared end ramp. Additional solutions are needed to prevent the flared end ramp and end cap from sliding or slipping with respect to each other once they are placed into an assembly.

SUMMARY

A need has been recognized for detachable end cap and flared end ramp components to a stormwater management system to improve the efficiency of forming, storing, packaging, and shipping multiple detachable flared end ramp and end cap components. A need has been recognized for improving the connection with and minimizing unwanted distortions in the placement of a stormwater chamber when connecting the chamber to a detachable endcap, and for securely connecting a separate pipe stub, end cap, and flared end ramp to a chamber. A need has also been recognized for facilitating improved connections among and between separable flared end ramp, end cap, and pipe components with a stormwater chamber. Solutions, apparatus, and methods are disclosed that allow for detachable end caps and flared end ramps to stormwater chambers. Additional solutions are disclosed to facilitate connections between detachable end caps, flared end ramps, pipe stubs, and chambers.

In an embodiment, an end cap may be provided for connecting a pipe to a stormwater chamber. The end cap may include a sleeve with an interior projecting edge, an outward projecting edge, and a bore. In some embodiments, the bore may be shaped to receive a pipe. The end cap may include a cutout portion at the upper half of the outward projecting edge of the sleeve and a cutout at the bottom half of the interior projecting edge of the sleeve. In other embodiments, the sleeve may be configured to connect to a flared end ramp at the interior projecting edge of the sleeve.

In some embodiments, the end cap may include an arch surface touching the top of the sleeve and one or more concave flared surfaces adjacent to the lower half of the bore connecting the sleeve to the arch surface. In other embodiments, the arch surface may include one or more notches configured to connect to a protrusion in a stormwater chamber. This connection may include a snap type connection. In yet other embodiments, the arch surface may be configured to connect with a scalloped edge portion in a corrugation of one edge of a stormwater chamber. In some embodiments, the end cap may include a bore that may be oval shaped with a horizontal axis longer than a vertical axis, though alternate embodiments where the vertical axis is longer than a horizontal axis, or a roughly circular diameter bore may be used. In other embodiments, the end cap may include reinforcing ribs on one side of the end cap.

In an embodiment, a flared end ramp may be provided for managing flow of material into a stormwater chamber. The flared end ramp may include an inlet end configured to connect to a pipe, an outlet end configured for placement within a stormwater chamber, and a protrusion on the outside of the inlet end configured to abut the flared end ramp with an end cap. In some embodiments, the flared end ramp may include an inclined surface extending between the inlet end and the outlet end of the flared end ramp configured to deliver material from the pipe into a stormwater chamber. In other embodiments, the outlet end of the flared end ramp may have a larger width than the inlet end of the flared end ramp such that the inclined surface is angled laterally outward from the inlet end toward the outlet end.

In other embodiments, a flared end ramp may be provided that includes an indent on the upper side of the inlet end configured to prevent the pipe from sliding towards the outlet end. In other embodiments, the indent may protrude upward from the upper side of the inlet end to a distance that is level with the inside diameter of a connecting pipe. In yet other embodiments, the flared end ramp may include at least one support foot configured to support the flared end ramp. The support foot may be located at the outlet end of the flared end ramp and may extend laterally from the flared end ramp.

In some embodiments, the flared end ramp may include an inclined surface that may include at least one drainage groove extending between the inlet end of the flared end ramp and the outlet end of the flared end ramp. The drainage groove may be angled laterally outward from the inlet end toward the outlet end.

In some embodiments, a stormwater chamber configured for use with an endcap may be provided. The stormwater chamber may include a plurality of corrugations formed into an arch and a first end configured to interface with an endcap. In some embodiments, the first end may include a scalloped edge portion to connect to the endcap. The endcap may have an elliptical shape with a vertical axis larger than the height of the arch. The stormwater chamber may further include a second end and one or more ribs located on the underside of one or more of the corrugations. In some embodiments, the ribs may be configured to secure a corrugated pipe inserted into the stormwater chamber.

In some embodiments, an apparatus for managing the storage and treatment of stormwater may be provided. The apparatus may include a stormwater chamber configured for use with an endcap, the stormwater chamber having a plurality of corrugations formed into an arch, a first end configured to interface with an endcap, the first end including a scalloped edge portion, a second end, and one or more ribs located on the underside of at least one of the corrugations, the one or more ribs configured to secure a corrugated pipe inserted into the stormwater chamber. The apparatus may further include an end cap for connecting a pipe to the stormwater chamber, the end cap including a sleeve with an interior projecting edge, an outward projecting edge, and a bore shaped to receive a pipe. The end cap may further include a cutout portion at the upper half of the outward projecting edge of the sleeve and a cutout at the bottom half of the interior projecting edge of the sleeve. The assembly may further include a corrugated pipe connected to the end cap, and the end cap may be inserted into the first end of the stormwater management chamber.

In other embodiments, the end cap in the apparatus may further include an arch surface touching the top of the sleeve and two flared surfaces adjacent to the lower half of the bore connecting the sleeve to the arch surface. In some embodiments, the flared surfaces may be concave, for example. In some embodiments, the arch surface may include one or more notches configured to connect the end cap to a protrusion in the stormwater chamber. The arch surface may be configured to interface with an edge portion of a corrugation at one edge of the stormwater chamber. In some embodiments, the edge portion may be scalloped, for example. In yet other embodiments, the bore in the end cap may be oval shaped with a horizontal axis longer than a vertical axis.

In other embodiments, the apparatus may further include a flared end ramp with an inlet end configured to connect to the pipe, an outlet end configured for placement within the stormwater chamber, a protrusion on the outside of the inlet end configured to abut the flared end ramp with the end cap, and an inclined surface extending between the inlet end and the outlet end of the flared end ramp and configured to deliver material from the pipe into the stormwater chamber. The outlet end of the flared end ramp may have a larger width than the inlet end of the flared end ramp such that the inclined surface is angled laterally outward from the inlet end toward the outlet end. In yet other embodiments, the corrugated pipe may be inserted into the sleeve of the end cap and may sit in the inlet end of the flared end ramp.

In yet other embodiments, the apparatus may further comprise an indent on the upper side of the inlet end of the flared end ramp configured to prevent the pipe from sliding towards the outlet end of the flared end ramp. In some embodiments, the flared end ramp in the apparatus may include an inclined surface with at least one drainage groove extending between the inlet end of the flared end ramp and the outlet end of the flared end ramp. The drainage groove may be angled laterally outward from the inlet end toward the outlet end.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Figure 1:
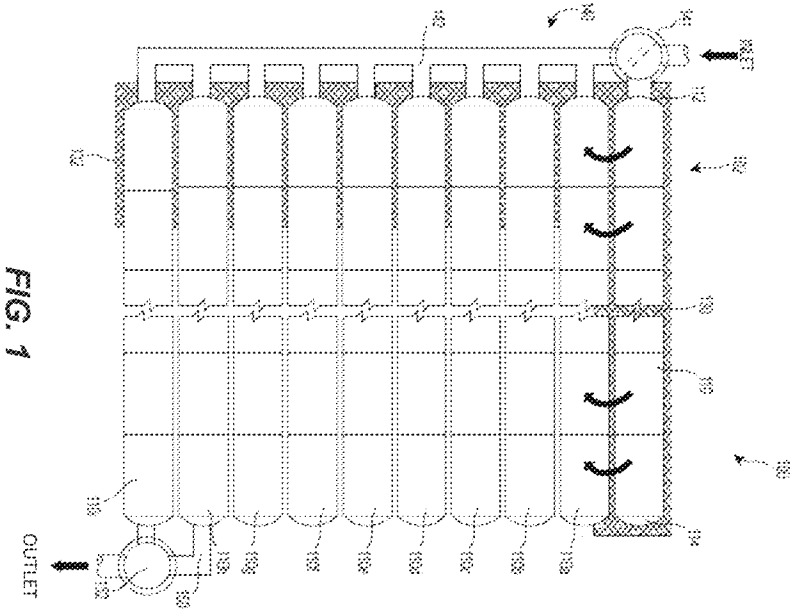
FIG. 1 depicts a schematic of an exemplary stormwater management system, consistent with various embodiments of the present disclosure.

Exemplary embodiments are described with reference to the accompanying drawings. In the figures, which are not necessarily drawn to scale, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items or meant to be limited to only the listed item or items. It should also be noted that as used in the present disclosure and in the appended claims, the singular forms "a," "an," and "the" include plural references unless the context clearly dictates otherwise.

A solution may be provided by embodiments disclosed herein to the recognized need for stormwater chambers configured to interface with detachable end caps, flared end ramps, and pipe stubs. In particular, apparatuses and methods in accordance with embodiments of the present disclosure may enable the manufacturing, shipping, and transport of detachable end cap and flared end ramp components. Solutions are disclosed that enable the connection and assembly of detachable end caps and separable pipe stubs to stormwater chambers. Additional solutions include the option to attach a separable flared end ramp assembly to the end cap for placement inside a stormwater chamber.

In various embodiments, an end cap apparatus may be provided that is constructed and arranged to attach to a stormwater chamber. The end cap apparatus may prevent earthen material or other unwanted debris from entering the stormwater chamber and may facilitate insertion of a pipe or pipe stub into the chamber through the use of a sleeve. In this configuration, stormwater or other fluids and materials may enter a stormwater chamber through a pipe stub inserted into the end cap that is placed into the stormwater chamber.

In various embodiments, a stormwater chamber may be provided that is constructed and configured to receive a detachable end cap. A stormwater chamber may include multiple corrugations formed into arch shapes. Solutions may include a non-uniform corrugation at one end of the chamber with a scalloped edge portion configured to accommodate a detachable end cap. The cutout portion may facilitate an improved fit and connection with the detachable end cap and avoid distortions in the bottom elevation of the stormwater chamber. Stormwater chambers may include ribs configured to interface and secure a corrugated pipe or pipe stub inserted into the chamber through the end cap. Such solutions may provide for a secure connection between a detachable pipe or pipe stub and the chamber when inserted through a detachable end cap.

In various embodiments, a ramp apparatus may be provided that is constructed and arranged to attach to, or be placed within, a chamber useful for a chamber-type stormwater management system. In particular, the ramp may be constructed and arranged to attach to, or be placed within, an interior surface of an end cap of a chamber of a stormwater management system. In this configuration, fluid and solid materials may exit an interior of the chamber by traversing the ramp and passing through an exit defined by the end cap of the chamber. For example, the ramp may be left in place during use of the stormwater system and may be available for periodic cleaning.

The ramp apparatus may be configured to improve chamber function over time, and may have a shape, form, and profile that is non-obtrusive and does not frustrate chamber function. For example, the ramp apparatus may provide an inclined surface from a ground on which the chamber is positioned to an exit passage at an end of the chamber. The ramp apparatus may be shaped to guide fluid and debris through the exit and away from the portions of the chamber interior at which debris and sediment may typically collect in related art systems, such as at the end cap interior around the exit of the chamber.

Figure 2:
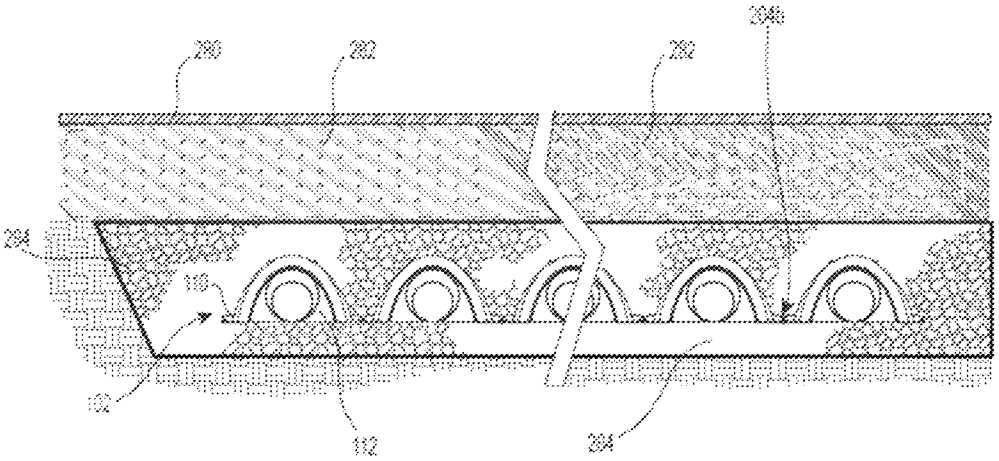
FIG. 2 depicts a side view of an array of the stormwater management system of FIG. 1 viewed below a ground surface, consistent with various embodiments of the present disclosure.

FIG. 1 depicts a top plan view of an example stormwater management system 100. System 100 may include an array 102 of stormwater chambers 110 arranged side-by-side in a row. FIG. 2 depicts a view of the stormwater chamber array 102 depicted in FIG. 1, showing the inlet ends of the stormwater chambers. In the embodiment depicted in FIG. 1, array 102 may include a first stormwater chamber 110 and additional stormwater chambers 110*a*-110*i*, all of which may have similar shapes and dimensions. However, any suitable number of stormwater chambers may be utilized with system 100. Each stormwater chamber of array 102 may be an open-bottom chamber with a side wall having a round or polygonal cross-section; in various embodiments, the side wall of one or more stormwater chambers of array 102 may be perforated. The stormwater chambers of array 102 may be corrugated in various embodiments and may be constructed of plastic (e.g., polypropylene, HDPE, LDPE, PVC), metal, and/or any other suitable material. The stormwater chambers of array 102 may each include an inlet end cap 112 and an outlet end cap 114 at its two respective ends.

As shown in FIG. 2, the chamber array 102 (including the first stormwater chamber 110) may be configured for placement beneath the surface 280 of the earth (e.g., under an automobile parking lot) within a layer of water permeable media 284, which may include crushed stone, gravel, round stone, and/or slag. Fill material 282 may fill the space between the surface 280 and the top of the water permeable media 284. In some embodiments, no spacing is required between two adjacent chambers when the chamber array 102 is installed underground. Alternatively, a gap 204*b* may be provided between two adjacent chambers.

The stormwater chambers of array 102 may be configured to receive and temporarily store rainwater and other fluids (referred to herein as "runoff") from one or more surface level drains. Over time, the chambers may disperse the runoff stored therein by percolation into the surrounding water permeable media 284 through the open bottoms of the chambers. In some embodiments, one or more stormwater chambers in array 102 may be configured to provide between 10 ft3 and 150 ft3 of chamber storage space for receiving the runoff, although persons of ordinary skill will understand that stormwater chambers having a storage volume greater than 150 ft3 or less than 10 ft3 may additionally or alternatively be used with system 100.

Returning to FIG. 1, stormwater management system 100 may include a subterranean inlet apparatus 140 configured to receive runoff from one or more surface drains, such as a combination of spaced apart catch basins interconnected by buried pipes. In some embodiments, runoff from the surface drains may flow through one or more settling devices before entering inlet apparatus 140, in order to settle out solids and floating matter. Inlet apparatus 140 may optionally include a diverter 141 configured to direct the received runoff into the first stormwater chamber 110 in the chamber array 102. As discussed below, a single layer filtration fabric 130 may be placed beneath the open bottom of the stormwater chamber 110 in order to capture and filter out sediment and other media from the runoff as the runoff flows out of the chamber. In various embodiments, filtration fabric 130 may be formed from a single layer of a woven geotextile fabric, such as a woven polypropylene material. Advantageously, providing filtration fabric 130 to capture sediment may protect the water permeable media 284 surrounding the stormwater chamber from sediment accumulation, which can slow or altogether halt the percolation of the filtered runoff into the earth. Additionally, filtration fabric 130 may provide scour protection for the underlying ground, including water permeable media 284. In some embodiments, fabric 130 may cover the entire open-bottom of stormwater chamber 110; alternatively, fabric 130 may cover a portion of the open-bottom of stormwater chamber 110, such as a section adjacent to the inlet end cap 112. In some embodiments, a single continuous piece of filtration fabric 130 may extend beneath the entire stormwater chamber array 102. Alternatively, one or more chambers 110 in the array 102 may have separate pieces of filtration fabric 130.

Figure 3:
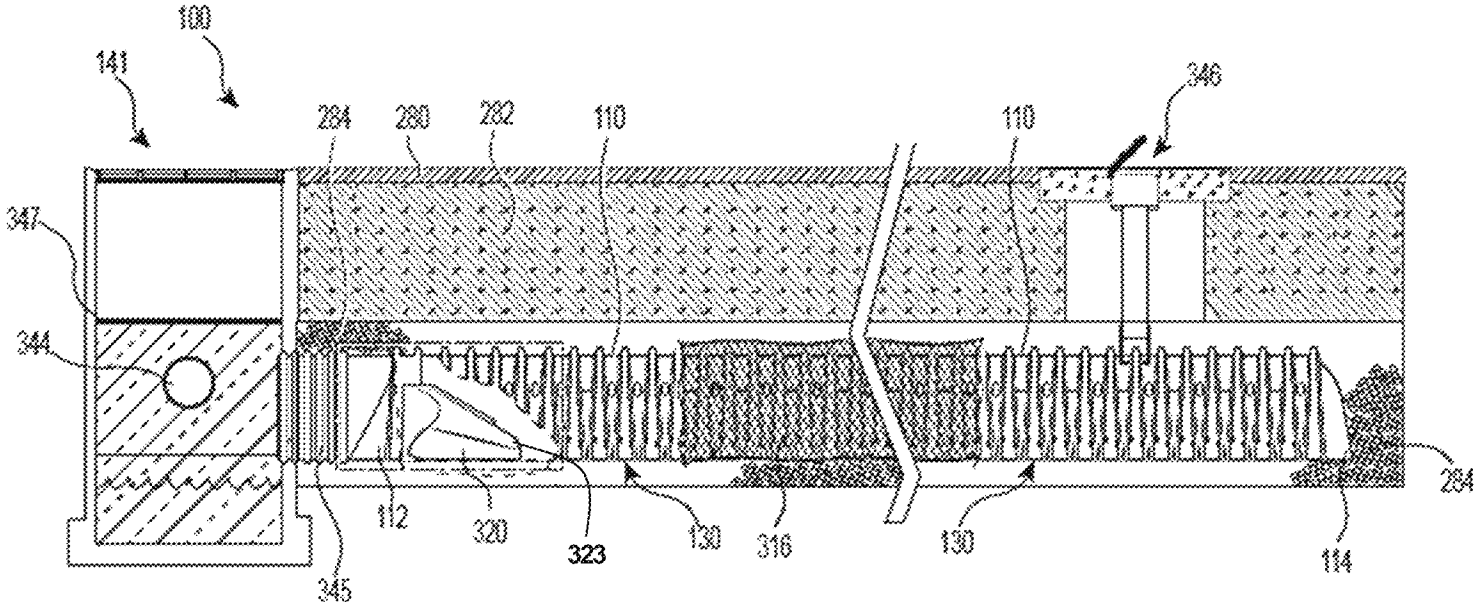
FIG. 3 depicts another side plan view of a stormwater chamber of the stormwater management system of FIG. 1, consistent with various embodiments of the present disclosure.

In some embodiments, when the first stormwater chamber 110 is full, or otherwise unable to receive additional runoff, diverter 141 may direct runoff to an inlet manifold 142 for delivery into one or more additional stormwater chambers 110*a*-110*i* of the chamber array 102. As illustrated in FIG. 3, diverter 141 may include an elevated bypass manifold 344 and/or an overflow weir 347 that may create a differential between the first stormwater chamber 110 and the rest of the chamber array 102, thus allowing chamber 110 and filtration fabric 130 to settle and filter the received runoff. Returning to FIG. 1, at least one of the additional chambers 110*a*-110*i* may include a single layer filtration fabric 132 that is similarly configured as filtration fabric 130. In alternative embodiments, the additional chambers 110*a*-110*i* may not have a filtration fabric. Optionally, one or more stormwater chambers in array 102 may include an outflow pipe 150 configured to discharge runoff from the chambers at a predetermined rate via an outlet control structure 152 (which may include, e.g., a fluid valve, a weir, an orifice, or other means of regulating discharge). The outlet may discharge runoff to a municipal storm sewer, pond, watercourse, or other receiving point via an underground drainage structure. In other embodiments, stormwater chamber 110 may have perforations on the side of the chamber. In this embodiment, runoff or other fluids may discharge through the perforations in the side of a chamber and into an adjacent chamber. For example, runoff may flow into chamber 110 through diverter 141 and discharge from chamber 110 into adjacent chamber 110*a* by passing through perforations in chambers 110 and 110*a*. In some embodiments, one or more chambers 110*a* through 110*i* may have perforations in their sides. Filtration fabric 130 may be wrapped around the sides of the chambers to prevent sediment and silt from entering the perforations, while allowing runoff or other fluids to enter and exit the chambers.

As shown in FIG. 3, an inlet pipe 345 (e.g., a stub pipe) may be provided to fluidly connect the inlet apparatus 140 (not shown in FIG. 3) to the stormwater chamber 110. The inlet pipe 345 may connect to the stormwater chamber 110 through the end cap 112. In some embodiments, a flared end ramp 320 may be positioned within the stormwater chamber 110 and may be angled downwards from the inlet pipe to convey the runoff away from the inlet end cap 112 and further into the chamber 110. In some embodiments, the inlet pipe 345 may extend through an opening in the inlet end cap and connect with an inlet end of the flared end ramp. In these embodiments, flared end ramp 320 may be situated entirely within stormwater chamber 110. Alternatively, the inlet end of the flared end ramp may be situated within the opening in the inlet end cap 112 or external to the stormwater chamber 110. In such embodiments, the flared end ramp 320 may extend through an opening in the inlet end cap 112 and into the stormwater chamber 110. As a result, the flared end ramp 320 may receive runoff from inlet pipe 345 (which may have a much smaller cross-section than chamber 110) and distribute the runoff across the width of the chamber 110. For example, the outlet end 323 of the flared end ramp may extend across the entire width of stormwater chamber 110 and may abut the chamber's inner surface 311 in some embodiments. Advantageously, the flared end ramp 320 may prevent sediment in the runoff from accumulating around the inlet end cap 112 by distributing the runoff (and the sediment contained therein) away from the chamber's inlet end and across the entire width of the chamber.

Figure 4A:
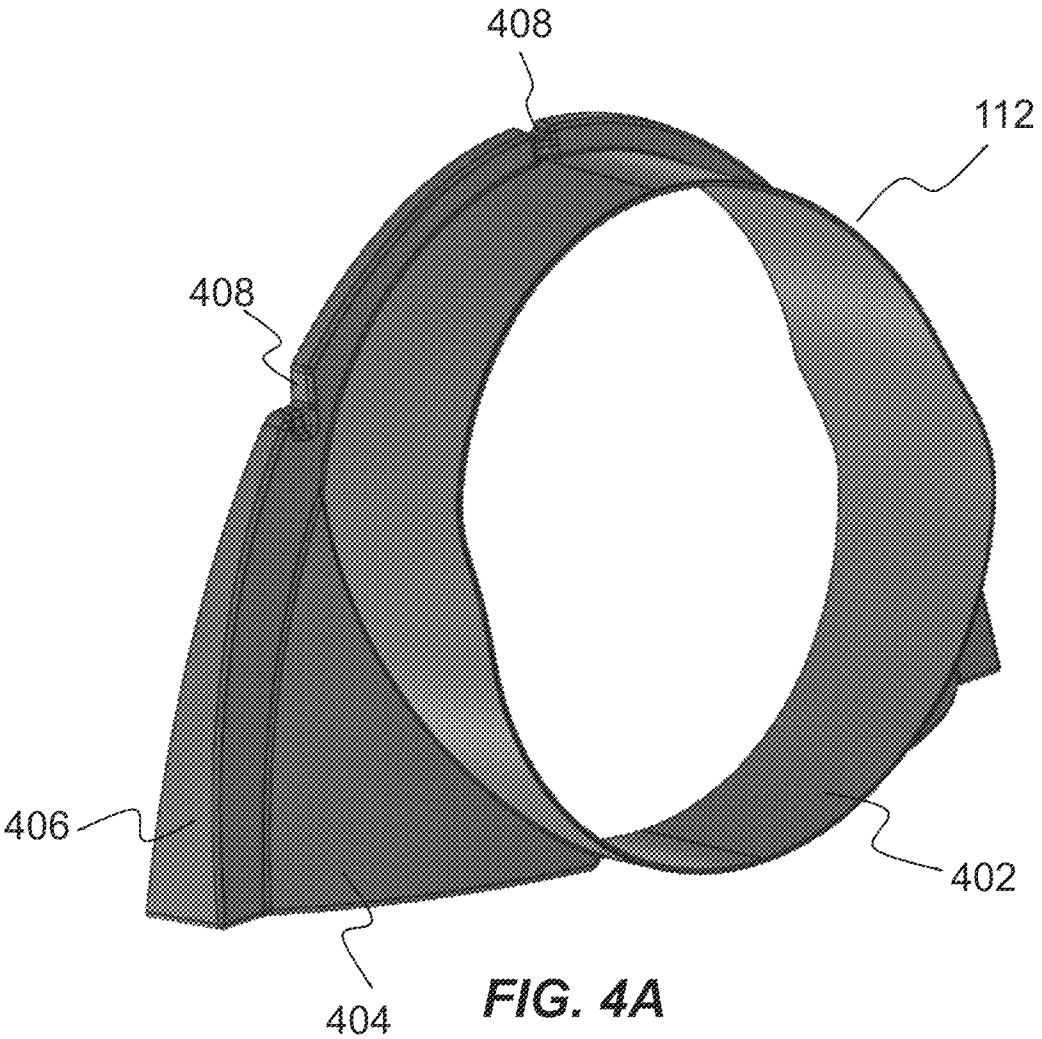
FIG. 4A depicts an example of an end cap for use with a stormwater chamber, consistent with various embodiments of the present disclosure.

FIG. 4A depicts an example embodiment of an end cap 112. End cap 112 may be configured to connect to a stormwater chamber 110 to close the end of the stormwater chamber and prevent the intrusion of soil, aggregate, or other unwanted debris. End cap 112 may be formed from plastics such as polypropylene, HDPE, LDPE, PVC, and may be formed using various molding techniques such as injection molding, roto molding, thermoforming, compression molding or other plastic molding techniques. In other embodiments, other suitable materials such as metals, may be used. As shown in FIG. 4A, end cap 112 may include sleeve 402. Sleeve 402 may be configured to receive a pipe or pipe stub, such as inlet pipe 345. Sleeve 402 may be round to accommodate inlet pipe 345. In one embodiment, sleeve 402 has an elliptical shape with a major access in the horizontal plane.

In some embodiments, end cap 112 may include an arch surface 406. Arch surface 406 may be configured to align with the geometry of an end of stormwater chamber 110. The radial geometry of sleeve 402 may not match the radial geometry of the stormwater chamber 110. For example, in an embodiment, the diameter of inlet pipe 345 may be larger than the height of the stormwater chamber 110. To accommodate the differences in the geometry of the sleeve 402 and the chamber, an arch surface 406 may abut sleeve 402 at the top of the sleeve and may not abut sleeve 402 at the bottom of the sleeve, as shown in FIG. 4A. Sleeve 402 may have an oval configuration with a horizontal axis larger than a vertical axis. In one embodiment, the horizontal axis is about 0.5 inches larger than the vertical axis when used in combination with a 36-inch internal diameter pipe stub. The oval configuration may allow an inlet pipe 345 inserted into the sleeve 402 to rest at the bottom elevation of the sleeve. For example, when used in combination with a flared end ramp, such as flared end ramp 320, additional width in the horizontal direction is needed to accommodate both the inlet end of flared end ramp 320 and inlet pipe 345 inside sleeve 402. Without the additional width in the horizontal direction, an inlet pipe inserted into the sleeve may become pinched on the sides of the inlet pipe and may not rest on the bottom of the sleeve, resulting in a poor fit between the inlet pipe and the end cap. The oval configuration may accommodate the features of the detachable flared end ramp, end cap, and inlet pipe. In another embodiment, sleeve 402 may have an oval configuration with a vertical axis larger than a horizontal axis. In yet another embodiment, sleeve 402 may be approximately circular. Sleeves with oval configurations with a vertical axis larger than a horizontal axis, or approximately circular sleeves, may be used in end caps that do not incorporate a flared end ramp, where the inlet pipe 345 can rest on the bottom of the sleeve without impediment.

End cap 112 may include flared surfaces 404 to close a gap between the arch 406 and the sleeve 402. In some embodiments, including as depicted in FIG. 4A, the flared surfaces 404 may have a concave shape on one side of the end cap. End cap 112 may also include connection slots 408. Connection slots 408 may be configured to interface with one or more protrusions in a stormwater chamber 110 to securely connect the end cap 112 to the stormwater chamber 110. In one embodiment, connection slots 408 may be configured to create a snap-fit connection with protrusions on stormwater chamber 110. Other connection types may be used. For example, in an alternative embodiment, connection slots 408 are secured through a friction-fit connection with protrusions in stormwater chamber 110. End cap 408 is not limited to snap or friction connections when connected to the stormwater chamber, and alternative embodiments incorporating fasteners or welding may be used.

Figure 4B:
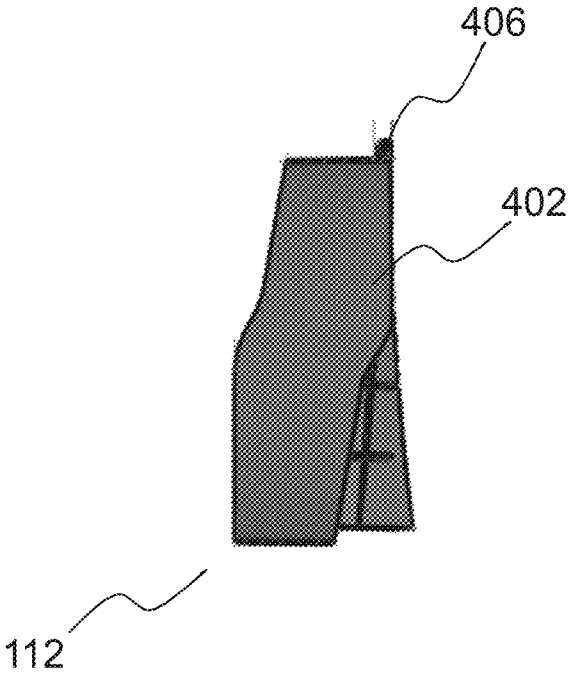
FIG. 4B depicts an example of an end cap shown from the side, consistent with various embodiments of the present disclosure.

FIG. 4B shows an embodiment of an end cap 112 when viewed from the side, with an interior projecting edge shown on the right side of the figure and an exterior projecting edge shown on the left side of the figure. As shown in FIG. 4B, the sleeve 402 of end cap 112 may include a cutout portion at the upper half of the outward projecting edge of the sleeve 402 and a cutout portion at the bottom portion of the interior projecting edge of the sleeve 402. Such cutout portions offer advantages in the storage, shipping, and transport of multiple end caps 112. For example, FIG. 4D shows an arrangement of multiple end caps (112A through 112H) for shipping. As shown in FIG. 4D, the end caps may be arranged advantageously so that the cutout portions in a sleeve 402 of an end cap 112 align with the sleeve in another end cap 112, allowing more end caps to be packaged and shipped in a single load than would be possible if the cutout portions were otherwise omitted.

Cutout portions of sleeve 402 may further improve the ease of installing or connecting inlet pipes, such as inlet pipe 345 to the end cap. For example, inlet pipe 345 may be installed by inserting the inlet pipe from above. The cutout portion on the upper half of the outward projecting edge of sleeve 402 allows the inlet pipe to be inserted into the sleeve from above and set down into the sleeve bottom. Sleeves formed without the cutout portions require a more difficult installation where the pipe stub may be be inserted directly in line with the bore of the sleeve. Thus, the cutout portions improve efficiency of the installation process.

Figure 4C:
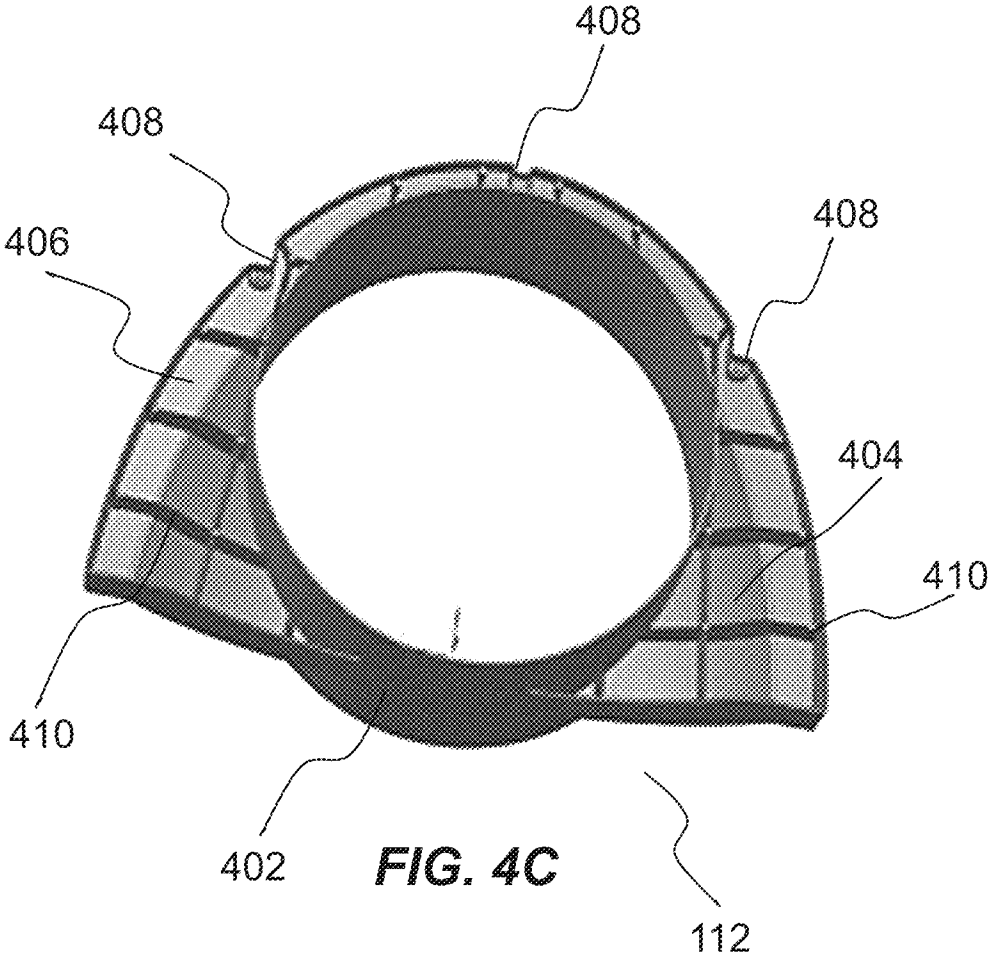
FIG. 4C depicts an example of the backside of end cap for use with a stormwater chamber, consistent with various embodiments of the present disclosure.
Figure 4D:
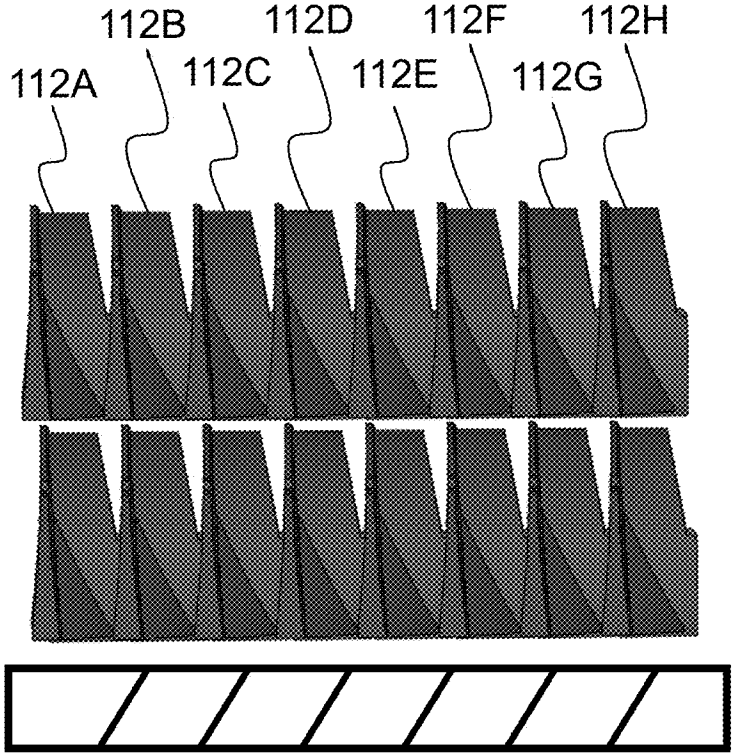
FIG. 4D depicts an example of multiple end caps arranged in a vertical stack, consistent with various embodiments of the present disclosure.

FIG. 4C shows an embodiment of end cap 112 when viewed from the interior projecting side. In some embodiments, end cap 112 may include reinforcing rib members 410. Reinforcing rib members 410 may provide rigidity and structural support to the end cap 112. in various embodiments, reinforcing rib members 410 may extend in the horizontal direction only, the vertical direction only, or in both the horizontal and vertical direction. In some embodiments, end cap 112 may not include any reinforcing rib members. As shown in FIG. 4C, sleeve 402, flared surfaces 404, and arch 406 may be formed as a single piece, typically though injection molding or other similar techniques.

Figure 5A:
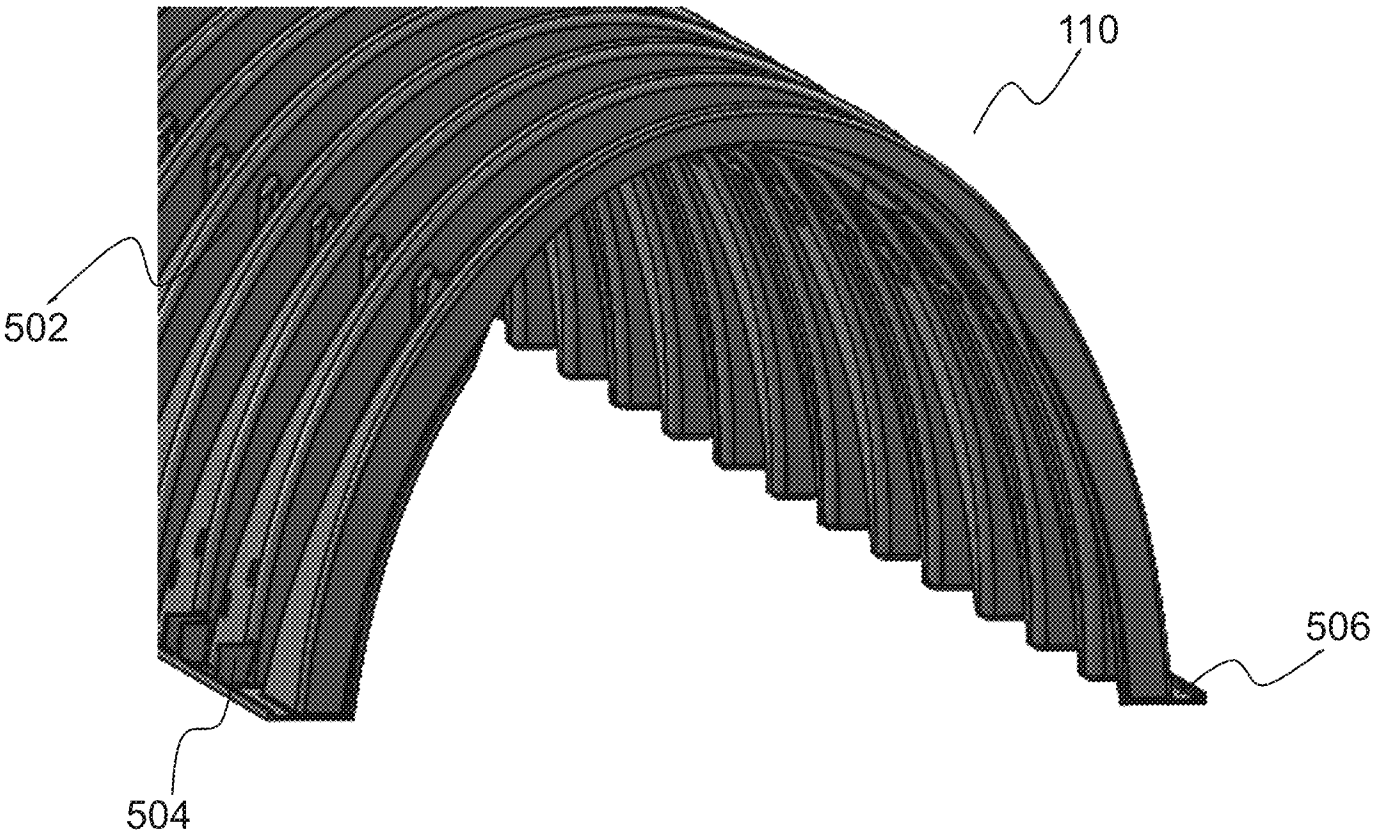
FIG. 5A depicts an example of a stormwater chamber, consistent with various embodiments of the present disclosure.

FIG. 5A shows an embodiment of part of a stormwater chamber 110 with the end cap removed. As shown in FIG. 5A, stormwater chamber 110 may be an arch shaped chamber having multiple corrugations, such as corrugation 502, and may have an open bottom. Corrugations 502 may attach to feet 506 placed at the bottom ends of the corrugations 502. Stacking flange, such as stacking flange 504, may be used to enable vertical stacking of more than one stormwater chamber 110. Multiple stormwater chambers 110 may be stacked vertically for storage or shipment. When stacked vertically, foot 506 of an upper stormwater chamber 110 may rest on top of stacking flange 504 of a lower stormwater chamber 110. Use of stacking flanges 504 may allow for ease of separation of stacked stormwater chambers and may prevent upper and lower stormwater chambers from inadvertently bonding through a friction-fit connection when stacked.

Figure 5B:
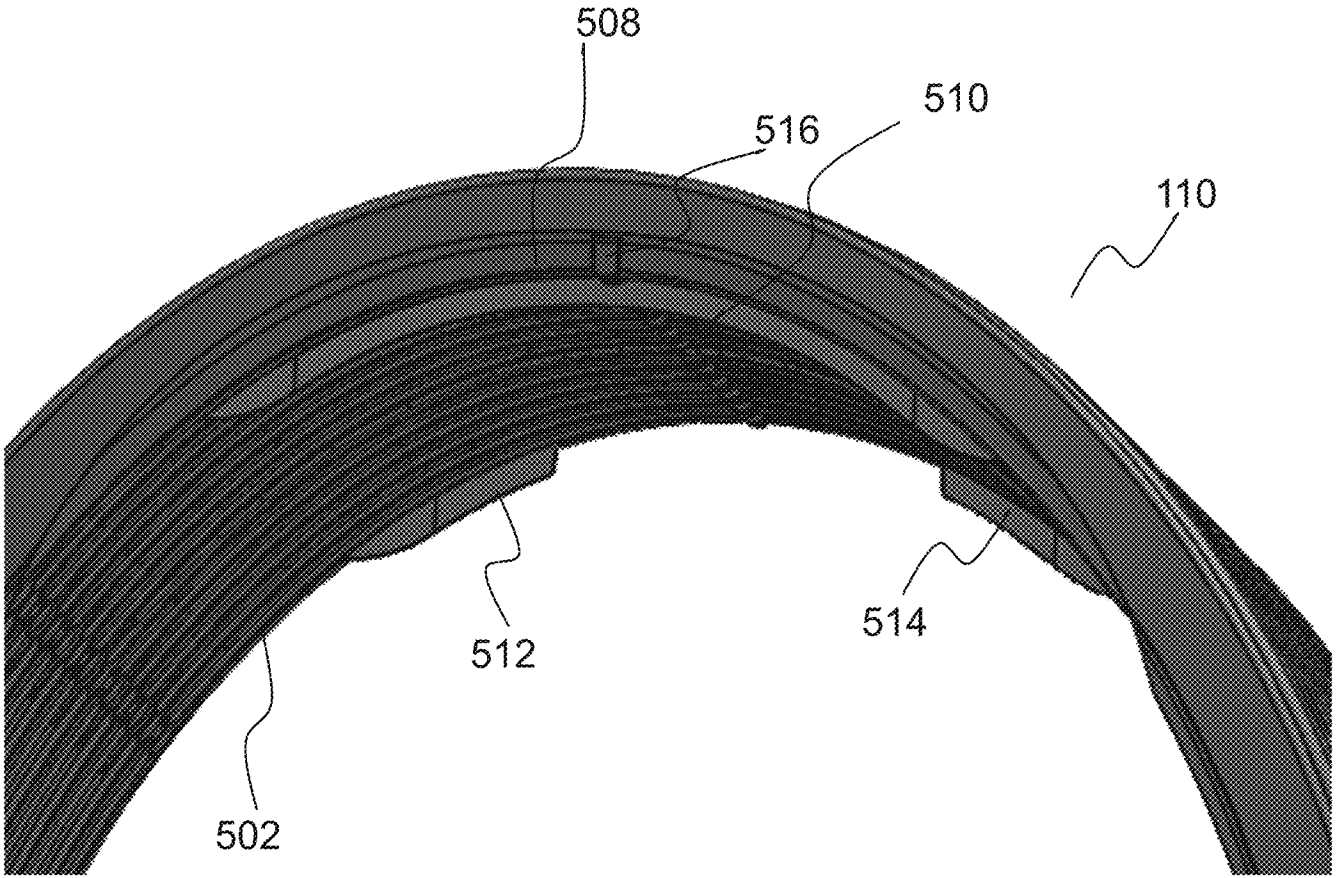
FIG. 5B depicts an enlarged view of a portion of the side of an example of a stormwater chamber.

A shown in FIG. 5B, stormwater chamber 110 may include features designed to enable connection of an end cap, such as end cap 112, and an inlet pipe, such as inlet pipe 345 (not shown in FIG. 5B). In one embodiment, stormwater chamber 110 may include one or more ribs located on the underside of the one or more corrugations configured to secure or stop a corrugated pipe that has been inserted into the stormwater chamber 110. For example, FIG. 5B depicts ribs 510, 512, and 514. Ribs may be formed in a continuous span underneath a corrugation 502, such as rib 510. Alternatively, or additionally, multiple ribs may be placed underneath a corrugation, such as ribs 512 and 514. In one embodiment, a stub pipe 345 is placed into the stormwater chamber through an end cap, such as end cap 112, and freely slides into the end cap until it contacts ribs 510, 512, or 514. That is, ribs act as a stop to prevent stub pipe 345 from entering too far into the chamber. In another embodiment, corrugated stub pipe 345 is inserted into a stormwater chamber 110 such that the ribs 510, 512, and 514 are seated in between the valleys of corrugations of the stub pipe, which holds the stub pipe inside the stormwater chamber 110.

Stormwater chamber 110 may include a first end configured to interface with an endcap, such as end cap 112. For example, FIG. 5B shows an example of a stormwater chamber 110 where the corrugation 502 located at one end of the chamber includes a scalloped edge portion 508. The scalloped edge portion 508 is a section of a corrugation located on the end of the stormwater chamber 110 that has been removed to accommodate the shape of an end cap, such as end cap 112 as further discussed below. Stormwater chamber 110 may include one or more snap connectors, such as snap connector 516. Snap connector 516 may be configured to create a snap fit with the snap connection slots 408 of end cap 112 (not depicted in FIG. 5B).

Figure 5C:
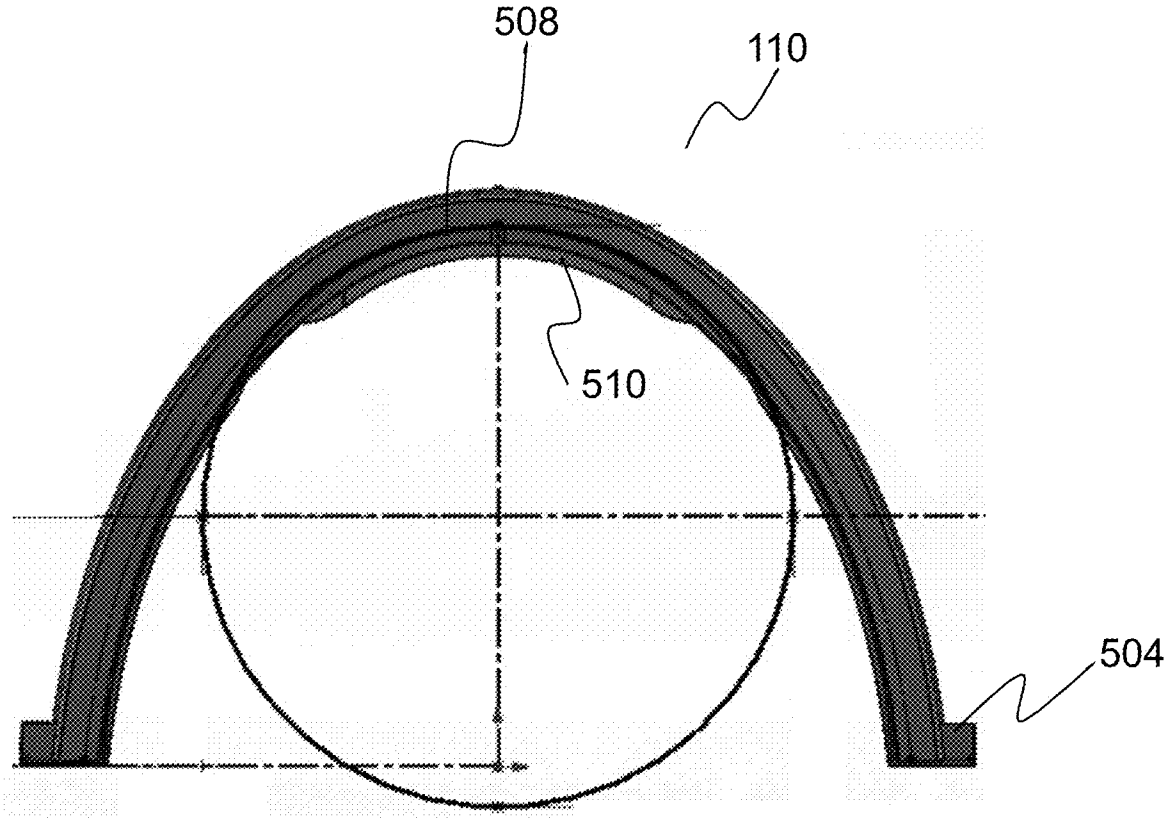
FIG. 5C depicts an example of a stormwater chamber viewed from one end with an overlay of an oval shape imposed over the end of the chamber.

FIG. 5C is a side view of an example of stormwater chamber 110 with an oval imposed over the chamber to illustrate the geometry of the scalloped edge portion 508. The oval may represent the dimensions of an end cap inserted into the chamber, such as end cap 112, the geometry of which is designed to accommodate a circular or oval shaped stub pipe 345. In an embodiment, the vertical axis of the oval shaped end cap 112 may be larger than the vertical axis of the arch shaped corrugations of stormwater chamber 110. For example, FIG. 5C shows an oval representing the dimensions of an end cap with a vertical axis that is larger than the vertical axis of the arch shaped corrugations of stormwater chamber 110. Scalloped edge portion 508 may solve problems in the fit between a desirable end cap and a stormwater chamber. Scalloped edge portion 508 may be a cutout portion in the corrugation located at one end of the stormwater chamber 110, which allows an end cap 112 to be inserted into the chamber 110. The scalloped edge portion 508 improves the connection and fit between end cap 112 and the stormwater chamber 110 and minimizes height distortions from the stormwater chamber 110 sitting on top of the end cap 112.

Figure 6:
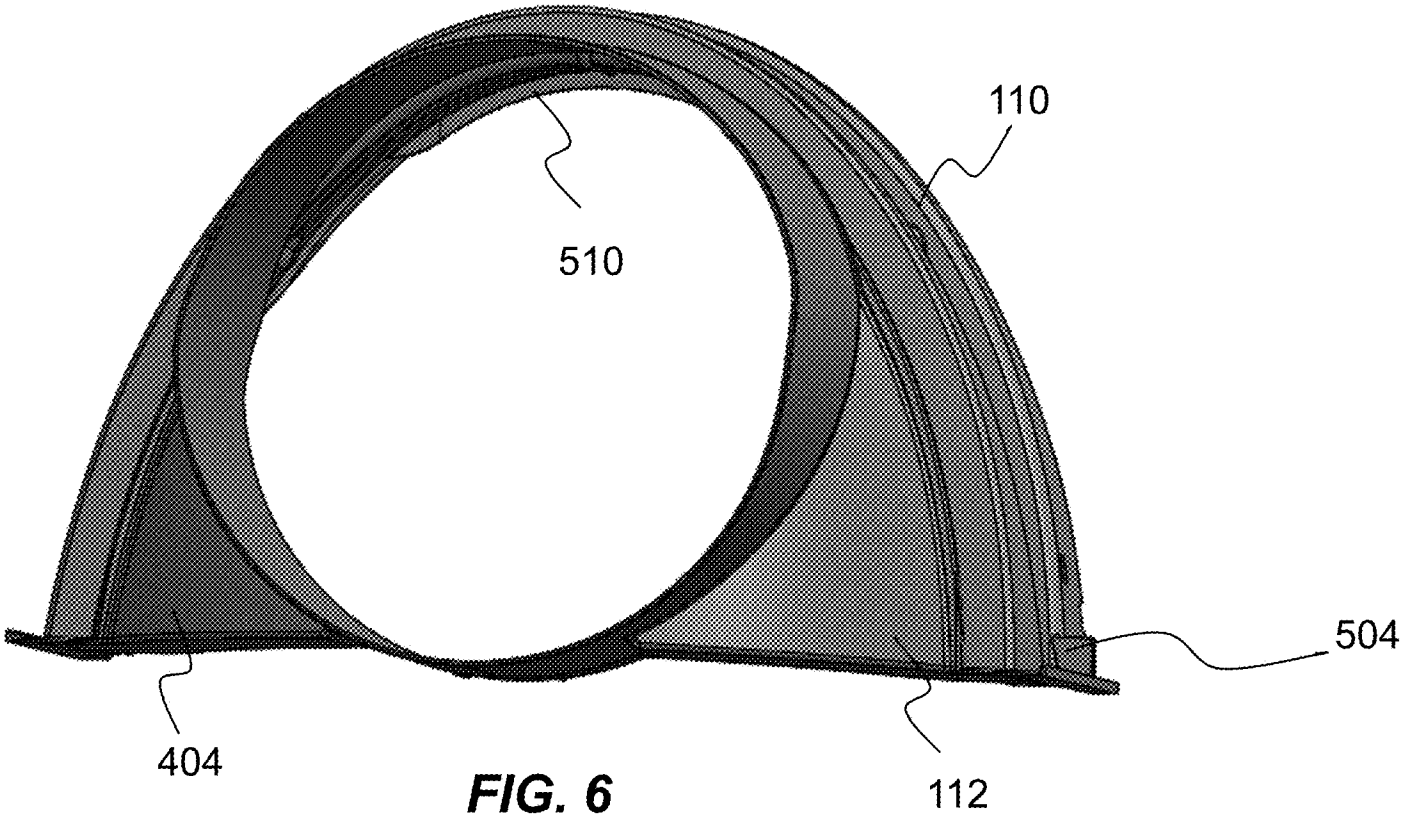
FIG. 6 depicts an example of an end cap inserted into a stormwater chamber, consistent with various embodiments of the present disclosure.

FIG. 6 shows an example of an end cap 112 inserted into a stormwater chamber 110. The stormwater chamber 110 includes a scalloped edge portion 508 which is obscured by the end cap 112 in FIG. 6 (scalloped edge portion 508 is not shown in FIG. 6). Use of the scalloped edge portion 508 improves the fit between end cap 112 and stormwater chamber 110 so that the bottom of flared surfaces 404 align with the bottom of flange 504 of the stormwater chamber 110.

Figure 7A:
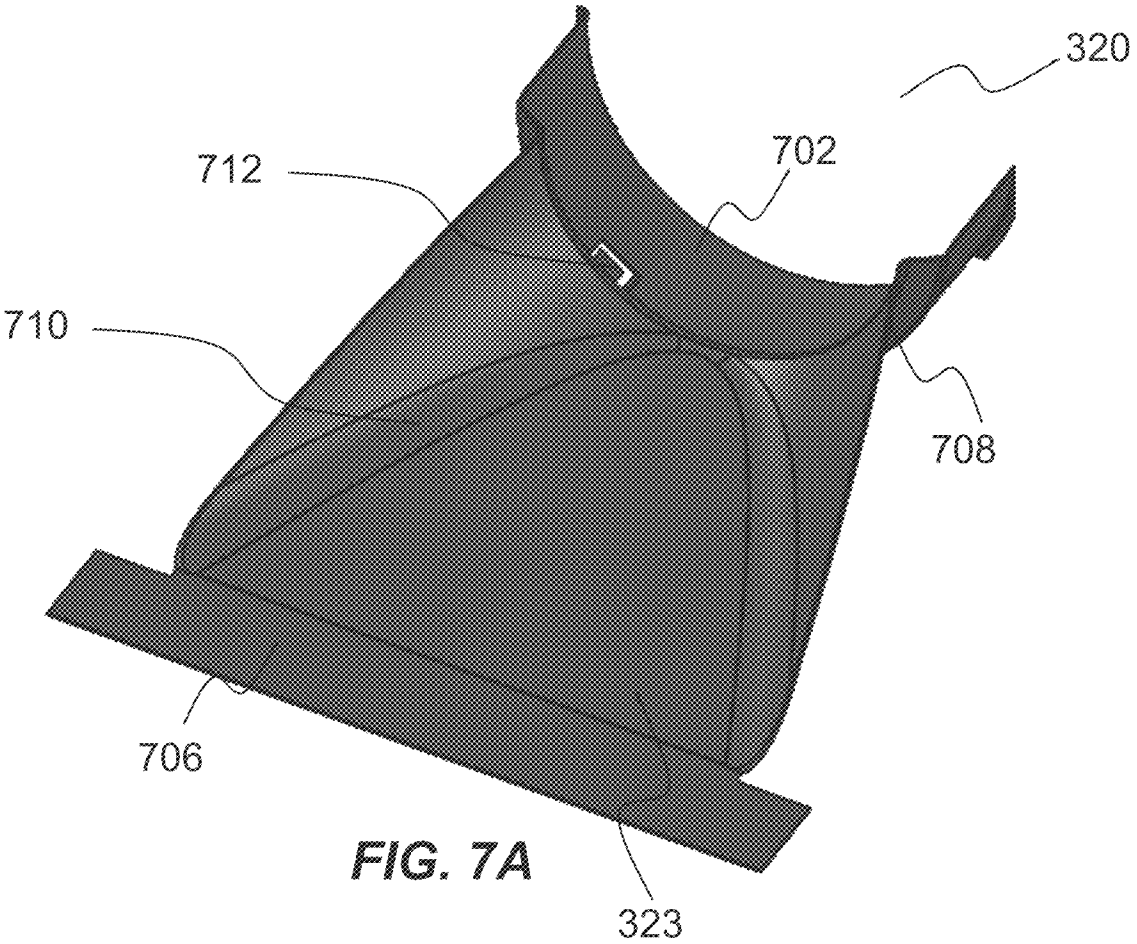
FIG. 7A depicts an example of a flared end ramp, consistent with various embodiments of the present disclosure.

FIG. 7A shows an example embodiment of flared end ramp 320. Flared end ramp 320 may be placed inside a stormwater chamber 110. In some embodiments, flared end ramp 320 may connect to an end cap, such as end cap 112. The inlet end 702 of the flared end ramp may have a smaller width than an outlet end 323 of the flared end ramp. For example, the outlet end 323 of the flared end ramp may extend across the entire width of stormwater chamber 110 and may abut the chamber's inner surface in some embodiments. Advantageously, this configuration may enable the flared end ramp 320 to prevent sediment in the runoff from accumulating around the inlet end cap 112 by distributing the runoff (and the sediment contained therein) away from the chamber's inlet end and across the entire width of the chamber. Inlet end 702 may have a semi-circular or semi-ovular shape with the upper half of the circle or oval omitted. The semi-circular or semi-ovular shape allows improvements in the storage, stacking, transport, and shipping of multiple flared end ramps 320 because multiple flared end ramps 320 with a semi-circular or semi-ovular shaped inlet end can be nested together. For example, FIG. 7C depicts multiple flared end ramps nested together. This nesting arrangement creates efficiencies in storage, stacking, transport, compared to flared end ramp sections with closed inlet ends, or compared to flared end ramps that are pre-attached or integrally formed with end caps.

Returning to FIG. 7A, flared end ramp 320 may include at least one support foot 706 attached to a bottom portion of the ramp at or near outlet end 323. The at least one support foot 706 may extend laterally from flared end ramp 320 to form a wide structure configured to support the ramp. In some embodiments, flared end ramp 320 may include pipe stop 708. Pipe stop 708 may be an indent on the upper side of inlet end 702 configured to stop an inlet pipe, such as inlet pipe 345 (not shown in FIG. 7A), from being inserted too far into flared end ramp 320. In an embodiment, pipe stop 708 is sized so that the invert of inlet pipe 345 aligns with the edge of the inclined surface located at the end of inlet end 702.

Figure 7B:
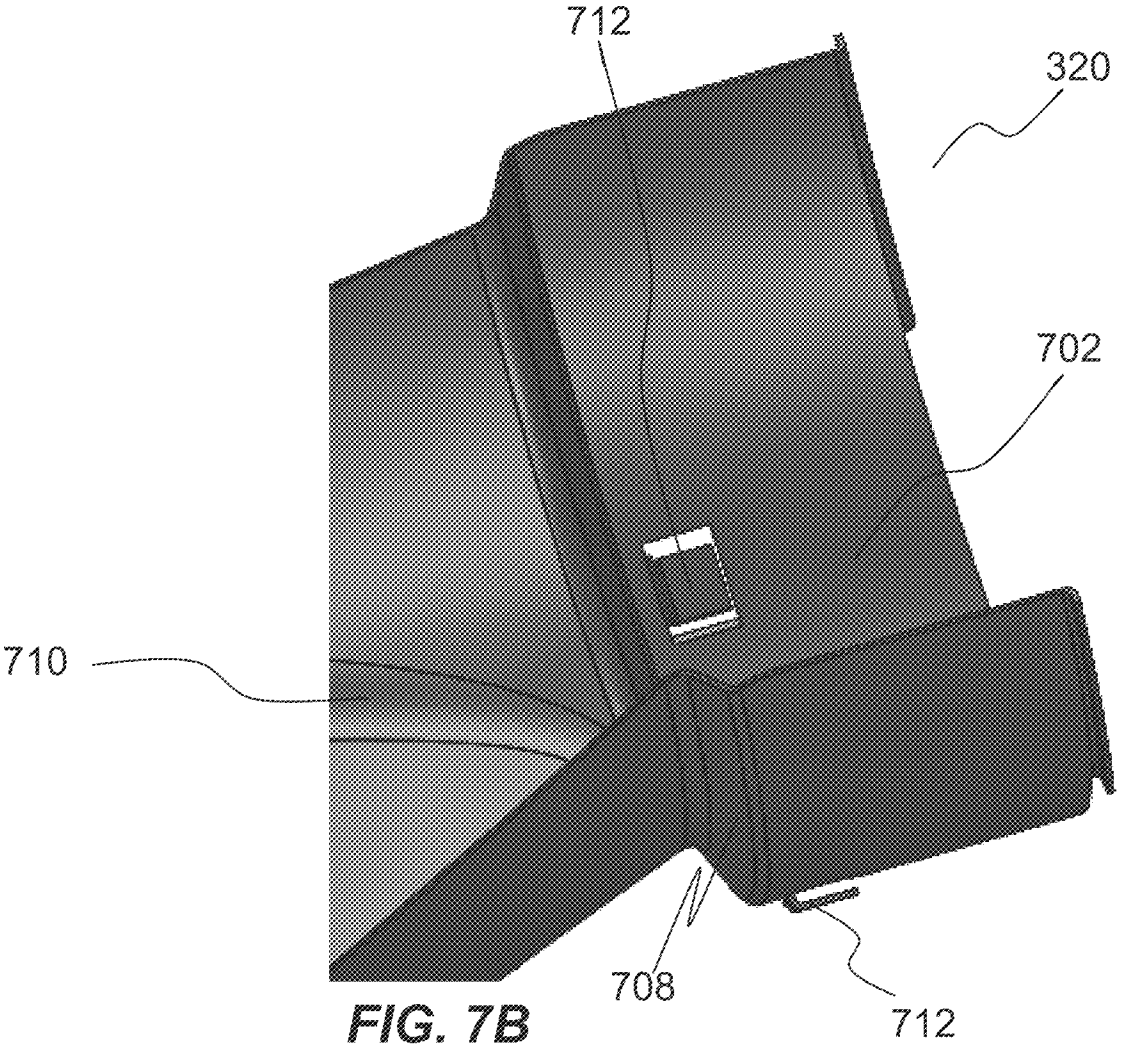
FIG. 7B depicts an enlarged view of one end of a flared end ramp, consistent with various embodiments of the present disclosure.
Figure 7C:
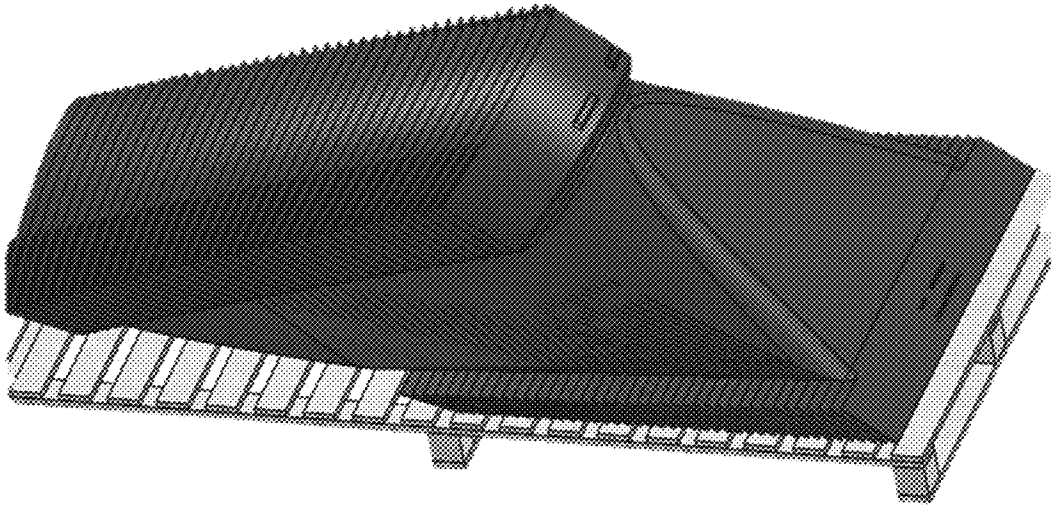
FIG. 7C depicts an example of multiple flared end ramps arranged in a stack, consistent with various embodiments of the present disclosure.

As shown in FIGS. 7A and 7B, flared end ramp 320 may include one or more drainage grooves formed in the inclined surface to promote flow of runoff from inlet end 702 towards outlet end 323. For example, as depicted in FIG. 7A, the flared end ramp may include a drainage groove 710 extending from near the center of the inclined surface at inlet end 702 and extending laterally outward towards outlet end 323. Advantageously, drainage grooves 710 may promote runoff away from the center of the stormwater chamber and towards the chamber side walls.

As shown in FIG. 7B, flared end ramp 320 may include one or more protrusions on the outside of the inlet end configured to abut flared end ramp 320 with an end cap, such as end cap 112. For example, the flared end ramp may include tabs 712. Tabs 712 may be configured to come in to contact with the interior projecting edge of sleeve 402 of end cap 112, which would prevent flared end ramp 320 from sliding too far towards end cap 112.

Figure 8:
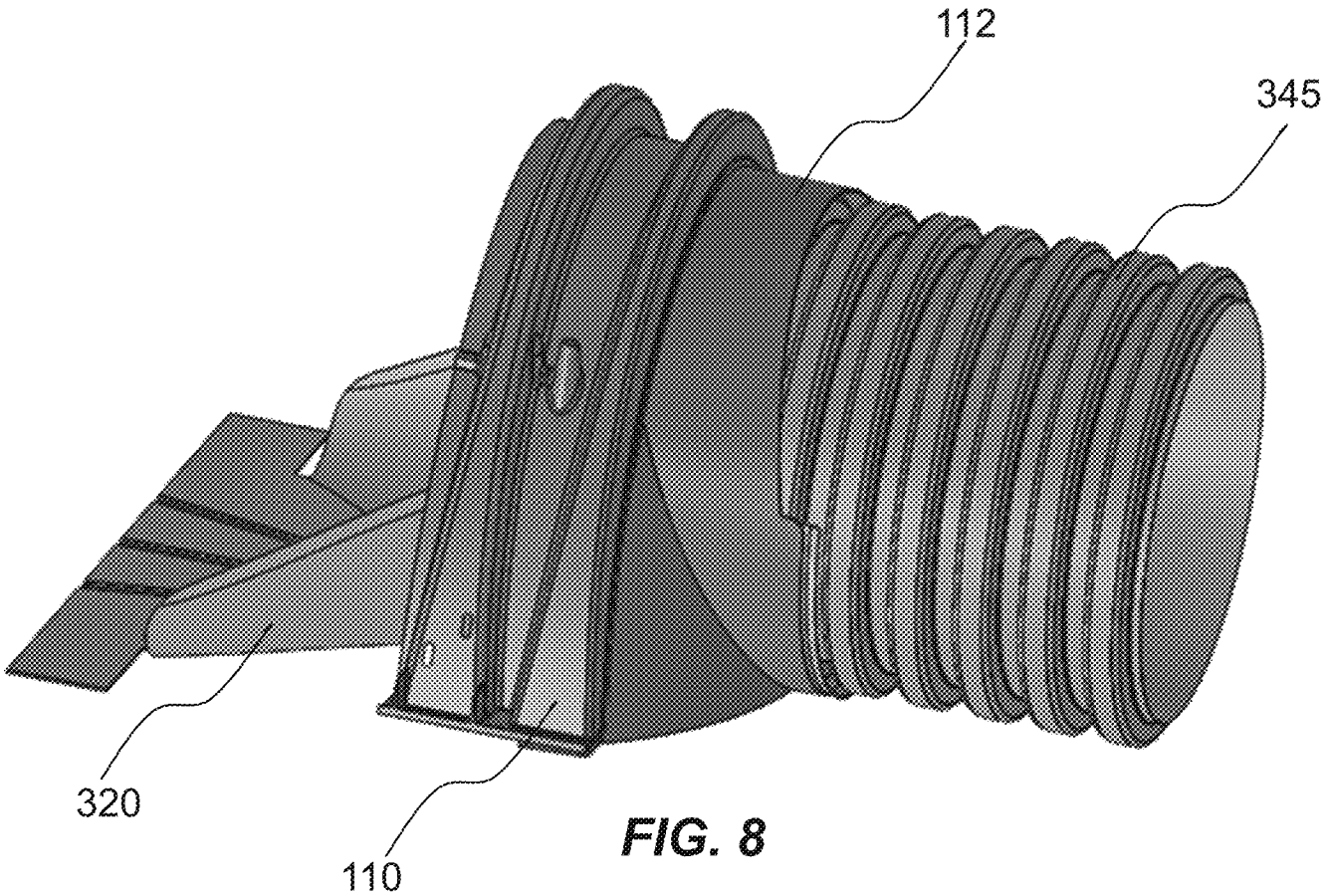
FIG. 8 depicts an assembly of an example flared end ramp, pipe, end cap, and stormwater chamber with part of the stormwater chamber omitted for clarity, consistent with various embodiments of the present disclosure.

FIG. 8 depicts an assembly of an example flared end ramp, inlet pipe, end cap, and stormwater chamber with part of the stormwater chamber omitted for clarity, consistent with various embodiments of the present disclosure. In an embodiment, end cap 112 may be inserted into an end of stormwater chamber 110 and may be secured to the chamber through use of snap connectors 516 and snap connection slots 408. Stormwater chamber 110 may include a scalloped edge portion 508 to accommodate the geometry of end cap 112. Optionally, a flared end ramp 320 may be placed against the interior edge of end cap 112, with tabs 712 contacting the interior edge of sleeve 402 of the end cap 112. Inlet pipe 345, which may be corrugated pipe in an embodiment, is inserted into the chamber through sleeve 402 of end cap 112. Inlet pipe 345 may be secured into the assembly by seating one or more of ribs 510, 512, or 514 between the corrugations of inlet pipe 345. Inlet pipe 345 may abut pipe stop 708 of flared end ramp 320. Fluids may enter stormwater system 110 by passing through inlet pipe 345, which is inserted into end cap 112. Fluid then passes from inlet pipe 345 to flared end ramp 320 into the chamber. Flared end ramp 320 is not required for a functional assembly. In an alternative embodiment, flared end ramp 320 is omitted from the assembly, and fluid enters stormwater chamber 110 by passing through inlet pipe 345, which is inserted into end cap 112, and then flow directly into the chamber.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. An end cap for connecting a pipe to a stormwater chamber, the end cap comprising:

a sleeve, the sleeve comprising:

an interior projecting edge;

an outward projecting edge; and a bore, the bore shaped to receive the pipe;

a first cutout portion at an upper half of the outward projecting edge of the sleeve, wherein the first cutout portion is configured to allow the pipe to be inserted through the first cutout portion into the sleeve from above and set down into a bottom of the sleeve;

a second cutout portion at a bottom half of the interior projecting edge of the sleeve;

an arch surface touching an upper portion of the sleeve; and two concave flared surfaces adjacent to a lower half of the bore connecting the sleeve to the arch surface.

2. The end cap of claim 1, wherein the arch surface includes one or more notches configured to connect to a protrusion in the stormwater chamber.

3. The end cap of claim 2, wherein the protrusion snap connects with the one or more notches.

4. The end cap of claim 1, wherein the arch surface is configured to connect with a scalloped edge corrugation at a top of one edge of the stormwater chamber.

5. The end cap of claim 1, wherein the bore is oval shaped with a dimension along a horizontal axis longer than a dimension along a vertical axis.

6. The end cap of claim 1, further comprising reinforcing ribs on one side of the end cap.

7. The end cap of claim 1, wherein the sleeve is configured to connect to a flared end ramp at the interior projecting edge.

8. An apparatus for managing storage and treatment of stormwater, the apparatus comprising:

a stormwater chamber configured for use with an endcap, the stormwater chamber comprising:

a plurality of corrugations having an arched shape, a first end configured to interface with the endcap, the first end including a scalloped edge portion;

a second end, and one or more ribs located on an underside of one or more of the corrugations, the one or more ribs configured to secure a pipe inserted into the stormwater chamber;

the end cap for connecting the pipe to the stormwater chamber, the end cap comprising:

a sleeve comprising:

an interior projecting edge;

an outward projecting edge; and a bore, the bore shaped to receive the pipe;

a first cutout portion at an upper half of the outward projecting edge of the sleeve, wherein the first cutout portion is configured to allow the pipe to be inserted through the first cutout portion into the sleeve from above and set down into a bottom of the sleeve; and a second cutout at a bottom half of the interior projecting edge of the sleeve; and the pipe; wherein:

the pipe is connected to the end cap; and the end cap is inserted into the first end of the stormwater chamber.

9. The apparatus of claim 8, further comprising a flared end ramp comprising:

an inlet end configured to connect to the pipe;

an outlet end configured for placement within the stormwater chamber;

a protrusion on an outside of the inlet end configured to abut the flared end ramp with the end cap; and an inclined surface extending between the inlet end and the outlet end of the flared end ramp and configured to deliver material from the pipe into the stormwater chamber, wherein the outlet end of the flared end ramp has a larger width than the inlet end of the flared end ramp such that the inclined surface is angled laterally outward from the inlet end toward the outlet end.

10. The apparatus of claim 9, further comprising an indent on an upper side of the inlet end configured to prevent the pipe from sliding towards the outlet end.

11. The apparatus of claim 10, wherein the indent protrudes upward from the upper side of the inlet end to a distance that is level with an inside diameter of the pipe.

12. The apparatus of claim 9, wherein the inclined surface includes at least one drainage groove extending between the inlet end of the flared end ramp and the outlet end of the flared end ramp, the drainage groove angled laterally outward from the inlet end toward the outlet end.

13. The apparatus of claim 8, wherein the end cap further comprises:

an arch surface touching a top of the sleeve; and two concave flared surfaces adjacent to a lower half of the bore connecting the sleeve to the arch surface.

14. The apparatus of claim 13, wherein the arch surface includes one or more notches configured to connect to a protrusion in the stormwater chamber.

15. The apparatus of claim 13, wherein the arch surface is configured to interface with the scalloped edge portion of the stormwater chamber.

16. The apparatus of claim 8, wherein the bore is oval shaped with a dimension along a horizontal axis longer than a dimension along a vertical axis.

* * * * *